US007424757B2

(12) United States Patent
Paul et al.

(10) Patent No.: US 7,424,757 B2
(45) Date of Patent: Sep. 16, 2008

(54) DISPOSABLE SLEEPING BAG

(75) Inventors: Gerald T. Paul, Whitelaw, WI (US); John C. Zacek, Green Bay, WI (US)

(73) Assignee: Little Rapids Corporation, Green Bay, WI (US)

( * ) Notice: Subject to any disclaimer, the term of this patent is extended or adjusted under 35 U.S.C. 154(b) by 336 days.

(21) Appl. No.: 11/278,192

(22) Filed: Mar. 31, 2006

(65) Prior Publication Data

US 2007/0226903 A1 Oct. 4, 2007

(51) Int. Cl.
*A47G 9/08* (2006.01)

(52) U.S. Cl. ..... 5/413 R; 5/644; 5/687; 53/434; 53/512; 206/494

(58) Field of Classification Search ..... 5/413 R, 5/413 AM, 644, 419, 687; 2/69.5; 53/434, 53/512; 206/494, 524.8
See application file for complete search history.

(56) References Cited

U.S. PATENT DOCUMENTS

| | | | | |
|---|---|---|---|---|
| 2,324,665 | A | 7/1943 | Ayres | |
| 2,625,695 | A | 1/1953 | Nicholson | |
| 3,460,170 | A | 8/1969 | Ozier | |
| 4,343,783 | A | 8/1982 | Hooper et al. | |
| 4,790,040 | A | 12/1988 | Grilliot et al. | |
| 4,895,171 | A | 1/1990 | Onik | |
| 4,977,632 | A | 12/1990 | Ong | |
| 5,033,135 | A | 7/1991 | Creek | |
| 5,068,936 | A | 12/1991 | Blitzer | |
| 5,184,361 | A * | 2/1993 | Canter et al. | 5/413 R |
| 5,240,112 | A * | 8/1993 | Newburger | 206/524.8 |
| 5,548,858 | A | 8/1996 | Shoa | |
| 5,762,643 | A | 6/1998 | Ray et al. | |
| 6,059,457 | A * | 5/2000 | Sprehe et al. | 383/63 |
| 6,560,797 | B2 | 5/2003 | Maturaporn | |
| 6,901,722 | B2 * | 6/2005 | Dextraze et al. | 53/399 |
| 2002/0157184 | A1 | 10/2002 | Maturaporn | |
| 2003/0204908 | A1 * | 11/2003 | Figler | 5/413 AM |
| 2006/0230533 | A1 * | 10/2006 | Liang | 5/413 R |
| 2007/0221532 | A1 * | 9/2007 | DiLiberto | 206/524.8 |

* cited by examiner

*Primary Examiner*—Alexander Grosz
(74) *Attorney, Agent, or Firm*—Godfrey & Kahn, S.C.; Alan R. Stewart

(57) ABSTRACT

A disposable or limited use sleeping bag kit including a sleeping bag made of a multi-layered material, an inflatable pillow and storage pouch from which air may be evacuated. The layered material of the sleeping bag may be made of an inner layer for contacting a user, an outer layer providing water and abrasion resistance, and a middle insulating layer between the inner and outer layers.

9 Claims, 4 Drawing Sheets

DISPOSABLE SLEEPING BAG

BACKGROUND

In emergency response situations, including reactions to large-scale natural disasters such as hurricanes, floods, tornadoes, earthquakes and similar events, it not uncommon that temporary shelter and sleeping arrangements need to be provided for a large number of persons. These temporarily housed persons may be residents affected or displaced by the events or the personnel mobilized to respond to the event. In such temporary shelter arrangements, it may be easier to find a place for a person to sleep but more difficult to provide this person with a desired array of bedding material to sleep in.

While such bedding may be stockpiled, these items may commonly be fairly bulky, taking an undesirably large amount of storage space. In addition, if multiple bedding items are being provided to each person, coordination of storage and distribution of the different items may pose logistical challenges. Once the bedding has been used, collection of the used material, cleaning and processing the bedding for future use may also be logistically difficult. It may be particularly difficult to repackage factory-prepared and packaged bedding into compact forms for storage.

Improvements to current temporary bedding solutions are desirable.

If a displaced person or a responder needs to move from one temporary housing location to another, it may also be desirable that the bedding material they are provided with may be conveniently recompacted for transportation and reuse by the individual.

SUMMARY

The present invention relates to a disposable or limited use sleeping bag kit including a sleeping bag made of a multi-layered material, an inflatable pillow and storage pouch from which air may be evacuated. The layered material of the sleeping bag may be made of an inner layer for contacting a user, an outer layer providing water and abrasion resistance, and a middle insulating layer between the inner and outer layers. The present invention also relates to disposable or limited use sleeping bag made from a layered material including a polypropylene inner layer, a polyester insulating layer and a polypropylene/polyethylene laminate outer layer.

BRIEF DESCRIPTION OF THE DRAWINGS

The accompanying drawings, which are incorporated in and form a part of the description, illustrate several aspects of the invention and together with the description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings and the description to refer to the same or like parts.

Figure 1:
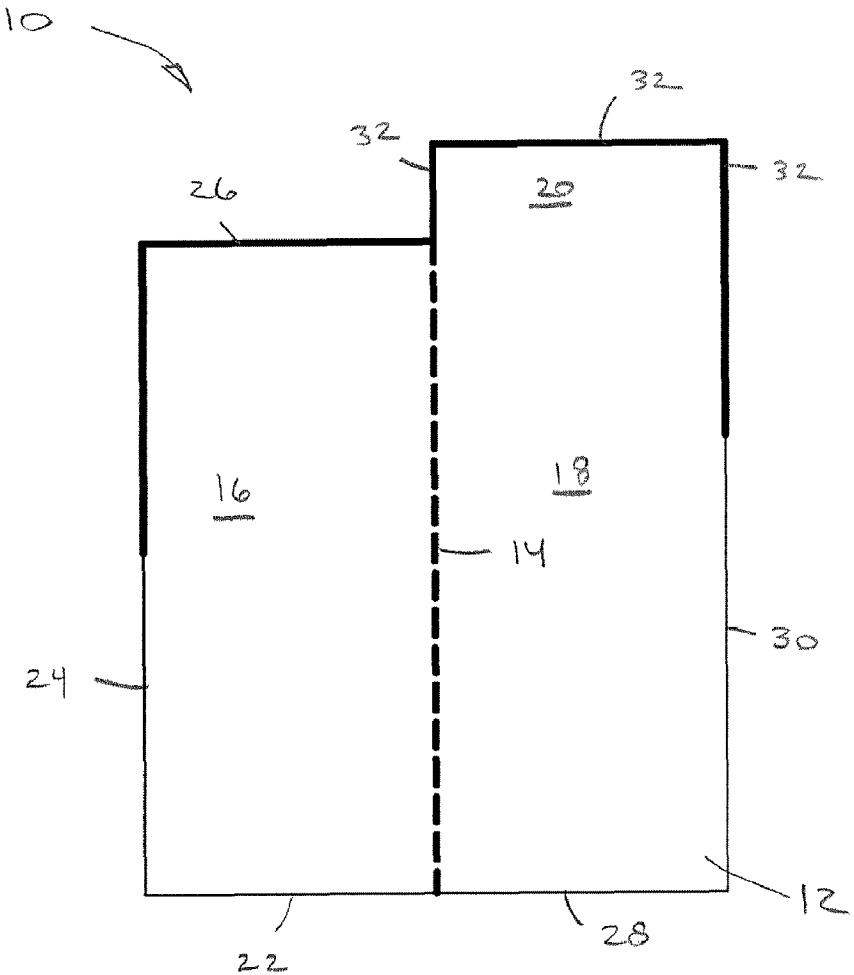
FIG. 1 is a top view of a layered material cut to be folded into a disposable or limited use sleeping bag according to the present invention.

Sleeping bags have conventionally been formed in a single sheet of material with a fold line generally down the center and some form of seal or closure around a perimeter of the bag when the bag is folded over the fold line. FIG. 1 shows a cut piece 10 of layered material 12 with a fold line 14. Cut piece 10 includes a top portion 16, and a bottom portion 18 with an extended head portion 20. Top portion 16 includes a foot edge 22, a side edge 24 and a head edge 26. Bottom portion 18 includes a foot edge 28, a side edge 30 and a head portion edge 32.

Figure 2:
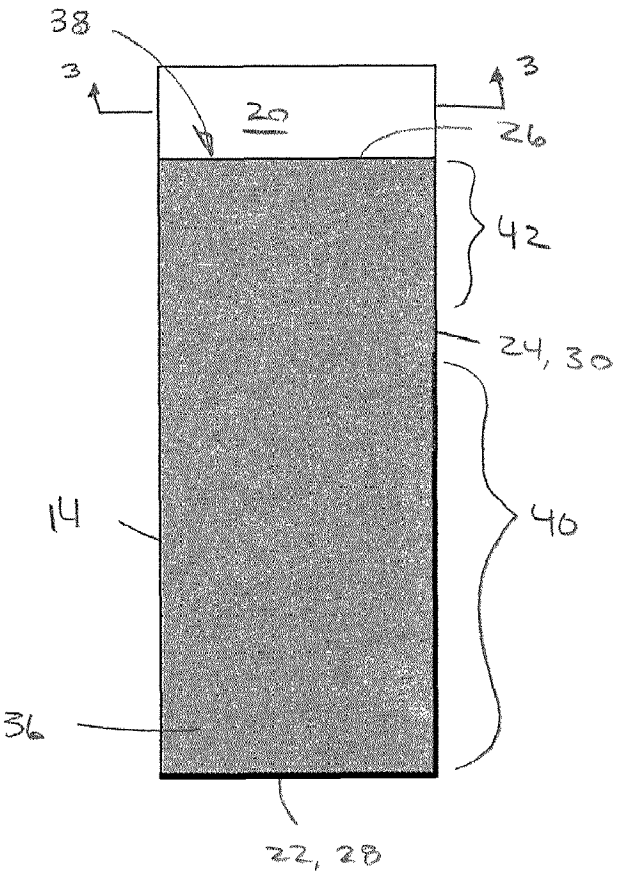
FIG. 2 is a top view of a disposable or limited use sleeping bag according to the present invention.

To assemble a sleeping bag 34, as shown in FIG. 2, cut piece 10 may be folded onto itself along fold line 14. Foot edges 22 and 28 and at least a first portion 40 of side edges 24 and 30 adjacent the foot edges may be sewn together to close off and define a foot end 36 of sleeping bag 34. A second portion 42 of sides edges 24 and 30 may unsewn or otherwise not joined together to facilitate entry of a user into bag 34 through a top opening 38 between head portion 20 and head edge 26.

Cut piece 10 also may include one or more sewn or otherwise finished hems. For example, along those second portion 42 of side edges 24 and 30 which are not sewn to each other, and along head edge 26 and head portion edges 32. These finished hems may aid in holding layered material 12 together. In addition, fold line 14 may be sewn or hemmed to provide a distinct line for folding cut piece 10 to form sleeping bag 34. While the edges, hems, and fold line have been described as having been sewn, it is intended that this description include other methods and processes of attaching top portion 16 to bottom portion 18 and for sealing edges 24, 26, and 30. Such methods may include but are not limited to taping, gluing, heat sealing, ultrasonic welding, or other similar and appropriate methods, based on the nature of the different components used in layered material 12.

Figure 3:
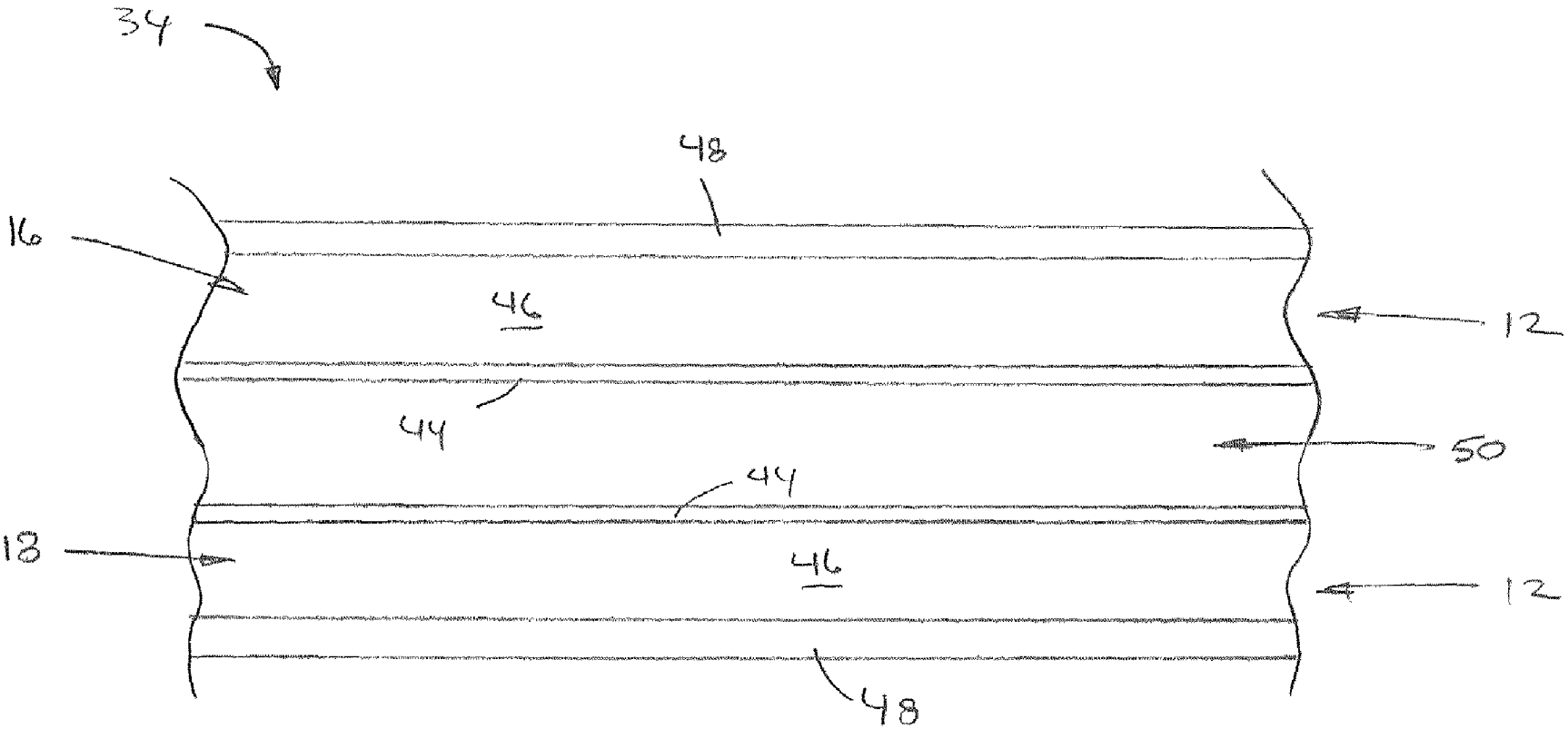
FIG. 3 is a cross-sectional view of the sleeping bag of FIG. 2, taken along line 3-3.

FIG. 3 illustrates a cross-section of sleeping bag 34 and shows an inner layer 44, a lofted insulation layer 46 and an outer layer 48. As cut piece 10 is folded over onto itself to form sleeping bag 34, cut piece 10 may be formed from a uniform layered material, with inner layer 44 on an opposite side of outer layer 48. When cut piece 10 is folded onto itself, inner layer 44 will form an inner surface throughout an inner space 50 defined within sleeping bag 34, and outer layer 48 will form a consistent outer surface of sleeping bag 34. This arrangement allows the materials of the inner, insulation and outer layers to be chosen to meet desired characteristics.

For example, inner layer 44 may be chosen to provide a softer hand to increase user comfort, such as by using a spunbond polypropylene material or other suitable materials chosen for comfort, limited use durability and the ease of disposal or recycling. An example of a preferable specification for inner layer 44 may be a spunbond white polypropylene, most preferably 25 grams per square meter, but other specifications may be used. Similarly, insulation layer 46 may be selected for efficient air entrapment to provide a desired level of insulation for a user, based on the expected location and environmental conditions of usage. Examples of suitable materials include but are not limited to needle punch polyester. An example of a preferable specification for insulation layer 46 may be a white polyester needle punch material, most preferably 100 grams per square meter, but other specifications may be used. Outer layer 48 may be chosen to provide a particular level of abrasion resistance for durability and some degree of water resistance. The selection of a suitable material or combination of materials may again be based on the expected location and environmental conditions of usage. Examples of suitable materials include but are not limited to a spunbond polypropylene material (as an outer layer for durability) laminated to a low density polyethylene film (as an inner layer adjacent insulation layer 46 for water resistance). An example of a preferable specification for outer layer 48 may be a spunbond grey polypropylene material, most preferably 40 grams per square meter, laminated to a low density polyethylene film, most preferably 20 grams per square meter, but other specifications may be used While different materials have been identified as appropriate for the uses and desired characteristics described above, other materials may be substituted based on the anticipated usage requirements. Greater or lesser levels of insulation may be desired. More or less durability in outer layer 48 may be desired. The need or desirability of included an outer moisture resistance layer may not be found in certain expected usage applications. While the above materials have been described based on an anticipated sheltered usage (such as in an emergency housing facility) it is also anticipated that sleeping bag 34 may be configured for outdoor usage as well. The different layers 44, 46 and 48 may be altered as needed to be suitable for such an outdoor use.

Figure 4:
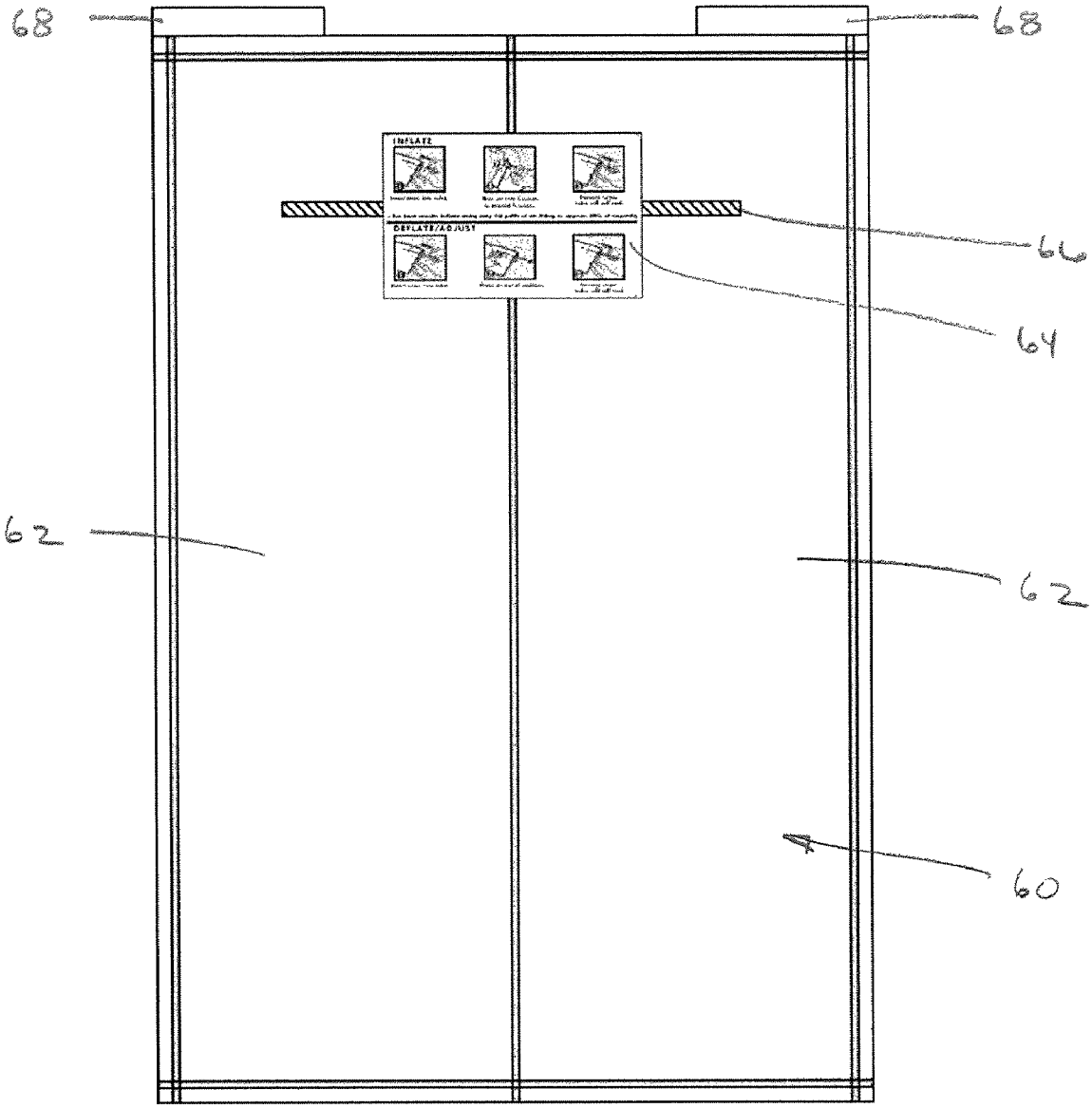
FIG. 4 is a top view of a pillow for use with the sleeping bag of FIG. 2.

FIG. 4 illustrates an inflatable pillow 60 which may include one or more chambers 62. Chambers 62, if there are multiple chambers, are preferably independently inflatable and deflatable. Attached to pillow 60, in the flattened form shown in FIG. 4, may be an adhesive label 64 holding a straw 66 to permit a user to inflate or deflate pillow 60 as desired. Each chamber 62 may include a valve 68 where straw 66 may be inserted to inject or release air from the chamber. Valve 68 may be configured as shown in commonly-owned U.S. Pat. No. 6,934,989, the disclosure of which is incorporated herein by reference, or may be some other suitable arrangement permitting easy inflation or deflation using attached straw 66 or a similar hollow instrument. Label 64 may also provide instructions to the user illustrating how to use straw 66 and valve 68 to inflate or deflate pillow 60.

Figure 5:
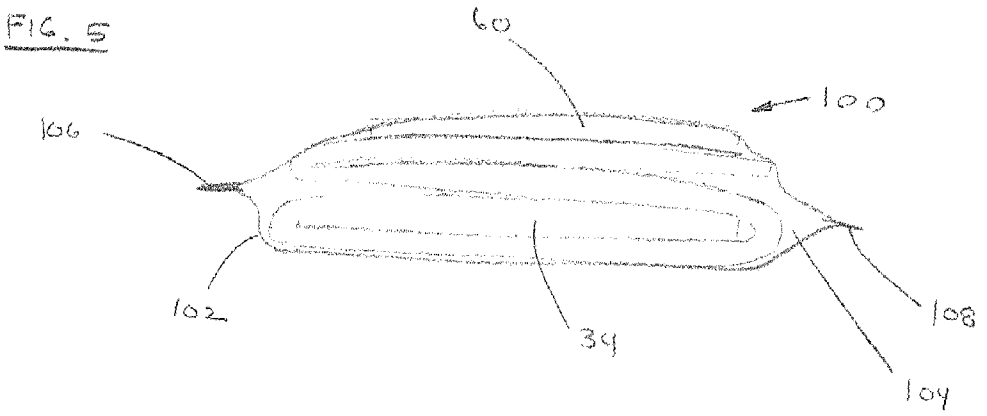
FIG. 5 is a side view of a disposable or limited use sleeping bag kit according to the present invention.
Figure 6:
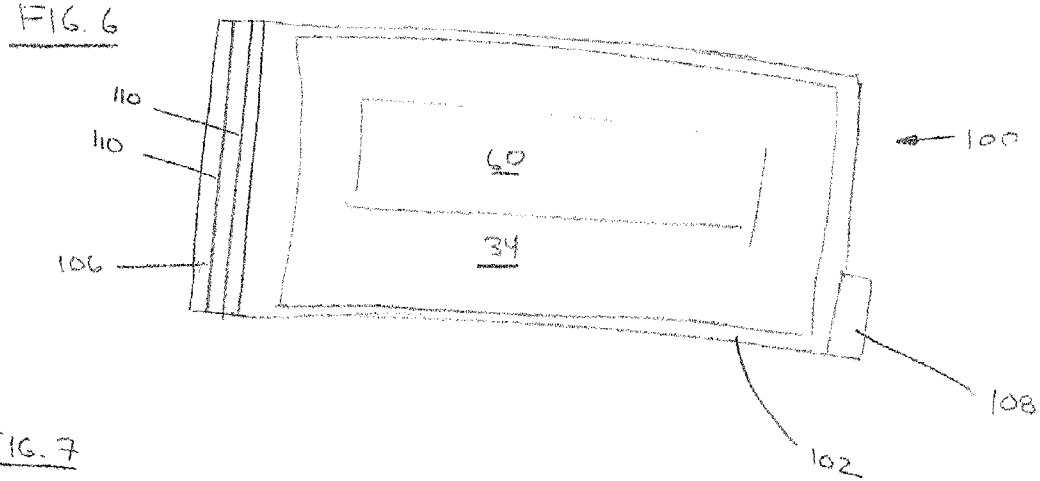
FIG. 6 is a top view of the sleeping bag kit of FIG. 5.

FIGS. 5 and 6 illustrate a kit 100 providing convenient storage and distribution of bedding materials. Kit 100 may include one sleeping bag 34 and one pillow 60 inserted within an interior space 104 of an airtight flexible container such as a pouch 102. Pouch 102 may have an opening 106 for insertion of sleeping bag 34 and pillow 60 into interior 104 and an air valve 108 providing an opening for removing air from within pouch 102. As shown, opening 106 and air valve opening 108 are at opposite ends of pouch 102. However, it is anticipated that the opening for insertion of materials within pouch 102 and the opening for evacuation of air from pouch 102 may be combined as a single opening and a separate opening with a valve 108 would not be needed.

As shown, opening 106 is closed by a resealable arrangement, such as at least one pair of interlocking ridges 110, commonly referred to as a ziplock or similar seal. Such resealable arrangements permit pouch 102 to be used several times if a user needs to move between multiple shelters or housing situations. Such a seal would allow for original compaction and storage of kit 100 in preparation for use in an emergency response event. Such a seal would also permit a user to fold sleeping bag 34, deflate pillow 60 and reinsert them into pouch 102. Pouch 102 could then be compressed, such as by sitting on pouch 102 or placing a heavy object onto the pouch. When compressed as desired, the interlocking ridges of opening 106 could be joined to reseal pouch 102 for compact transportation. Opening 106 may preferably include two pairs of interlocking ridges 110 to provide a more secure and airtight seal of interior 104.

Figure 7:
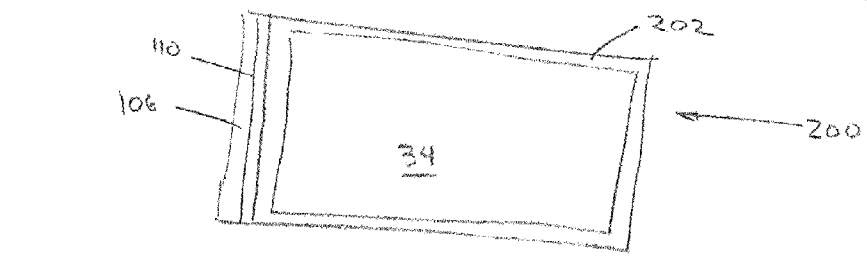
FIG. 7 is a top view an alternative embodiment of a sleeping bag kit according to the present invention.

FIG. 7 shows an alternative embodiment kit 200 with sleeping bag 34 stored within a storage pouch 202 with opening 106 at one end. Materials may be inserted within and removed from pouch 202 through opening 106 and air may be evacuated from pouch 202 also through opening 106. A single set of interlocking ridges 110 are provided adjacent opening 106 to permit sealing of pouch 202 once air has been evacuated.

It should be noted that pouch 102 may be left in an evacuated state for long periods of time. Pouch 102 is thus preferably made of a material that is impervious to air, but which is also preferably flexible and durable so that it collapses easily around stored articles and may be used a number of times without degradation of its air-tight qualities. Preferably, pouch 102 may be constructed of a durable, clear airtight material, such as but not limited to polyethylene, having a suitable thickness, such as but not limited to approximately 2.5 mil. One suitable alternative material is commercially available as "Curlon," which is a flexible, formable material comprising a laminate of polyethylene and nylon, available from Curwood, Inc. In another embodiment, pouch 102 is made of tri-extruded polyethylene film. Such a film may, for example, be composed of three (3) layers. An outer layer may be a linear low density polyethylene, an intermediate sandwich layer may be a linear low density polyethylene/low density polyethylene, and an inside layer may be a low density polyethylene. All three layers may, for example, be made from virgin materials with no diarylides or heavy metals. If incinerated, such a layered film emits no harmful gases and produces a clean ash. Such laminated or layered materials are disclosed in U.S. Pat. Nos. 5,203,458, and 5,480,030.

In still another alternative embodiment, pouch 102 may be made of a blended extrusion layer of polyethylene sandwiched between a nylon layer and a layer of polyethylene sheeting, as disclosed in U.S. Pat. No. 6,408,872. It may also be desirable that the materials comprising the pouch 102 may be altered so as to prevent interaction with the pouch contents. Such a composition of pouch 102 may be determined using material qualities known in the art or by experimentation. Of course, many other materials and combinations of materials may be used, as is well known to those skilled in the art.

Sleeping bag 34 may be packaged in pouch 102 without a pillow 60 or with some other head support or rest arrangement. Examples of other head rests might be a pouch for packing with a soft article, such as a piece of clothing, that may be used as a pillow. Additional items may be packaged with kit 100 as well, such as information or instruction sheets relating to the use and care of the items in kit 100 or other relevant items.

The embodiments of the invention disclosed herein have been discussed for the purpose of familiarizing the reader with novel aspects of the present invention. Although the preferred embodiments have been shown and described, many changes, modifications and substitutions may be made by one having skill in the art without necessarily departing from the spirit and scope of the present invention. Having described preferred aspects and embodiments of the present invention, modifications and equivalents of the disclosed concepts may readily occur to one skilled in the art. However, it is intended that such modifications and equivalents be included within the scope of the claims which are appended hereto.

What is claimed is:

1. A disposable sleeping bag kit comprising:

a sleeping bag including:

a body portion defining an inner cavity with an opening allowing a user to enter the cavity, the body portion formed of a layered material comprising:

an inner layer including a spunbond polypropylene, providing a soft surface for contacting a user;

an insulation layer including a lofted needle punch polyester material;

an outer layer providing resistance to abrasion and water infiltration and including a spunbond polypropylene laminated to a polyethylene film;

a head portion, constructed of the same layered material as the body portion, connected to the body portion adjacent the opening;

a selectively inflatable and deflatable pillow with an inflation device, the inflation device allowing for air to be selectively injected into and released from the pillow, comprised of two independently inflatable and deflatable chambers;

a storage pouch made of an air impermeable material, the pouch including an opening for selectively inserting and removing the sleeping bag and the pillow from the pouch and an opening for evacuating air from within the pouch.

2. The disposable sleeping bag kit of claim 1, wherein the inflation device includes a straw and an air valve integrated into the pillow, the straw sized to be inserted through the integral air valve allowing air to be injected or released from the pillow.

3. The disposable sleeping bag kit of claim 1, further comprising the storage pouch constructed of a polyethylene material.

4. The disposable sleeping bag kit of claim 1, further comprising the storage pouch constructed of a multi-layered material including at least one layer of polyethylene.

5. The disposable sleeping bag kit of claim 1, wherein the opening for insertion and removal of the sleeping bag and the pillow from the storage pouch is at one end of the storage pouch and the opening for evacuation of air from the storage pouch is at an opposite end of the storage pouch.

6. The disposable sleeping bag kit of claim 1, wherein the opening for insertion and removal of the sleeping bag and the pillow from the storage pouch is closed by at least a pair of interlocking ridges formed in sides of the storage pouch adjacent the opening.

7. The disposable sleeping bag kit of claim 1, wherein two pairs of interlocking ridges are formed in the sides of the storage pouch adjacent the opening.

8. The disposable sleeping bag of claim 1, wherein the layered material forming the sleeping bag is a single cut piece including a top portion and a bottom portion, the top portion folding over the bottom portion along a fold line to form the inner cavity.

9. The disposable sleeping bag of claim 8, wherein the top portion and the bottom portion are joined along a foot edge opposite the head portion and a segment of a side edge opposite the fold line, and a remainder of outer edges of the top portion and the bottom portion are hemmed to prevent the edges raveling but are not attached to each other.

* * * * *